United States Patent [19]

Wittrisch

[11] Patent Number: 4,715,446

[45] Date of Patent: Dec. 29, 1987

[54] DEVICE AND METHOD FOR THE TEMPORARY PROTECTION OF A WORKING TOOL OR MEASURING INSTRUMENT FIXED TO THE END OF A DRILL STRING

[75] Inventor: Christian Wittrisch, Rueil Malmaison, France

[73] Assignee: Institut Francais du Petrole, Rueil-Malmaison, France

[21] Appl. No.: 875,975

[22] Filed: Jun. 19, 1986

[30] Foreign Application Priority Data

Jun. 19, 1985 [FR] France ..... 85 09434

[51] Int. Cl.[4] ..... E21B 23/00

[52] U.S. Cl. ..... 166/381; 166/250

[58] Field of Search ..... 166/381-383, 166/250, 255, 242, 243; 175/40, 45

[56] References Cited

U.S. PATENT DOCUMENTS 4,349,072 9/1982 Escaron et al. ..... 166/250

4,457,370 7/1984 Wittrisch ..... 166/250

*Primary Examiner*—Stephen J. Novosad

*Assistant Examiner*—Thuy M. Bui

*Attorney, Agent, or Firm*—Antonelli, Terry & Wands

[57] ABSTRACT

The present invention provides a device and method for protecting, by means of a casing, a measuring instrument or a specialzied tool fixed to the end of a drill string. Said drill string has substantially at is end and before said tool a first guide member and said casing has a second guide member, said first and second guide member being adapted for cooperating together so as to allow movement of said casing relatively to said tool or instrument.

16 Claims, 6 Drawing Figures

DEVICE AND METHOD FOR THE TEMPORARY PROTECTION OF A WORKING TOOL OR MEASURING INSTRUMENT FIXED TO THE END OF A DRILL STRING

BACKGROUND OF THE INVENTION

1. Field of the Invention

The present invention relates to a device and method for protecting a tool such as a measuring instrument (probe) or a specialized working tool in a well, this tool being fixed to the end of a drill string.

2. Description of the Prior Art

In the devices and methods of the prior art, the tool or instrument is caused to leave its protective casing or jacket by a movement of the tool or instrument relatively to the drill string and to the casing, the casing being fixed relative to the drill string.

Such an operating mode has numerous drawbacks. In fact, very often the specialized tools, such as well logging probes, require an electric connection with the surface of the well. This connection is generally provided by a cable and it therefore advisable to provide members which ensure the electric continuity of the connection during movement of the tool. Such members are particularly fragile and present difficulties in use.

Moreover, very often, the devices of the prior art move the tool by pumping liquid inside a hollow string. This results in violently propelling the probe with the risks of damage thereto, particularly if the well is obstructed.

The prior art may be illustrated by the French Pat. No. FR-A-2 547 861, European Pat. No. EP-A-0 122 839 and the U.S. Pat. No. 4,349,072.

The present invention overcomes these drawbacks by providing a retractable protective device for a specialized instrument or tool working in a well, this tool or instrument being fixed to the end of a drill string.

SUMMARY OF THE INVENTION

The device of the invention comprises a casing or jacket for protecting said tool or instrument and is characterized in that the drill string has, substantially at its end and before said tool or instrument, a first guide member and in that the casing has a second guide member, these first and second guide members being adapted for cooperating together so as to allow movement of the casing relative to the tool or instrument.

The device of the present invention may include means for anchoring and locking the casing relatively to the assembly formed by said drill string and said tool or instrument.

These anchoring means may be adapted for immobilizing the casing when the casing protects the tool or instrument, or when the casing does not protect said tool or instrument. The casing may include means for centering in the well.

The device of the present invention may include means for moving the casing relatively to the assembly formed by said drill string column and said tool or instrument.

The present invention also provides a method of protection using a protective casing or jacket for a specialized instrument or tool working in a well, this tool or instrument being fixed to the end of a drill string.

The method of the invention is characterized in that the casing is mounted for sliding relatively to the assembly formed by the tool or instrument and the drill string.

According to the present invention, the assembly formed by the drill string and the tool or instrument may be moved for removing the tool from its protective casing. Thus, the casing remains substantially immobile relatively to the well.

Still within the scope of the present invention, for working with the tool or instrument in a given zone of the well, the assembly formed by the drill string and the casing is moved beyond this zone while the casing is in the position protecting the tool or instrument and the tool is uncovered during the movement, or just before the movement of this assembly in the opposite direction and before again reaching the working zone.

BRIEF DESCRIPTION OF THE DRAWINGS

The present invention will be better understood and its advantages will be clear from the following description of examples which are in no wise limitative, illustrated by the accompanying drawings in which.

DESCRIPTION OF THE PREFERRED EMBODIMENTS

Figure 1:
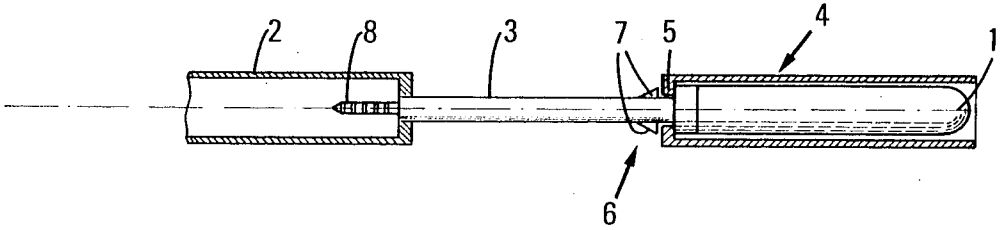
FIGS. 1 and 2 illustrate a simple embodiment of the device of the invention.

FIG. 1 illustrates a simple embodiment of the device of the invention.

Reference 1 designates a tool or instrument to be uncovered temporarily. This tool, which may be a well logging probe or any other tool, is fixed to a drill string 2 which may be a drill pipe string, by means of a first guide member 3 which in the case of FIG. 1 is a cylinder.

Reference 4 designates a protective casing or jacket. This casing includes a second guide member 5, such as bearings which may slide over the first guide member 3.

FIG. 1 shows the casing 4 in a position protecting the tool 1.

Casing 4 may be held in this position by anchoring or locking means 6. In FIG. 1 these locking means comprise retractable dogs 7. These dogs may be remote controlled electromagnetically.

Since such anchoring means are well known to a man versed in the art, they will not be described here in detail.

Figure 2:
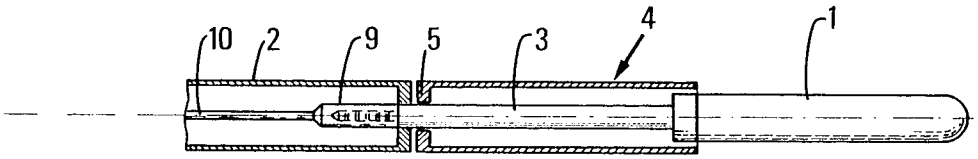

When it is desired to uncover tool 1, as is shown in FIG. 2, the dogs 7 are retracted and the casing 4 is moved so as to uncover the tool to be protected 1 which may then be activated for carrying out the operation for which it is designed.

In the example shown in FIG. 1, the tool to be protected as well as the means 6 for locking the casing to the guide member require an electric connection with the equipment situated for example on the surface.

A male connector 8 fixed to the inside of the column will allow this connectio. A female connector 9 fixed to the end of the cable 10 is adapted for cooperating with the male connector 8. The female connector 9 may be lowered into the drill string by gravity and/or possibly by pumping.

The projection and retraction of dog 7 may be controlled by electric signals transmitted through conductors incorporated in a drill string.

Movement of the casing may be produced in several ways.

In what follows, several moving methods will be mentioned which in no wise limit the scope of the present invention.

In the case where the friction of the casing on the walls of the well is sufficiently higher than that of the casing on the probe, it will be possible to have locking means 6 which immobilize the probe in its protective position illustrated in FIG. 1. Thus, during lowering of the tool, this latter remains protected.

When it is desired to uncover the tool retraction of the locking means 6 is controlled for example by means of electric signals transmitted through cable 10 and the connectors 8 and 9. It is then sufficient to push on the drill string to cause the tool 1 to leave the casing 4, as is the case in FIGS. 2 and 4.

The casing 4 will not advance if the forces which retain it and which are due to the forces between the casing and the walls of the well are sufficient to overcome the drive forces which result from the forces due to the friction of the casing on the probe and possibly to the weight of the casing. Of course, the forces due to the weight of the casing do not come into play when the probe is brought out in a horizontal portion of a well.

It is obvious that if the tool is to be moved in the direction of a deeper and deeper penetration into the well, while out of its casing, it will not be necessary to lock the casing 4 in the tool extended position.

On the other hand, if the tool is to be moved in the opposite direction, while out of its casing, it will be necessary to lock the casing in the extended tool position.

Figure 4:
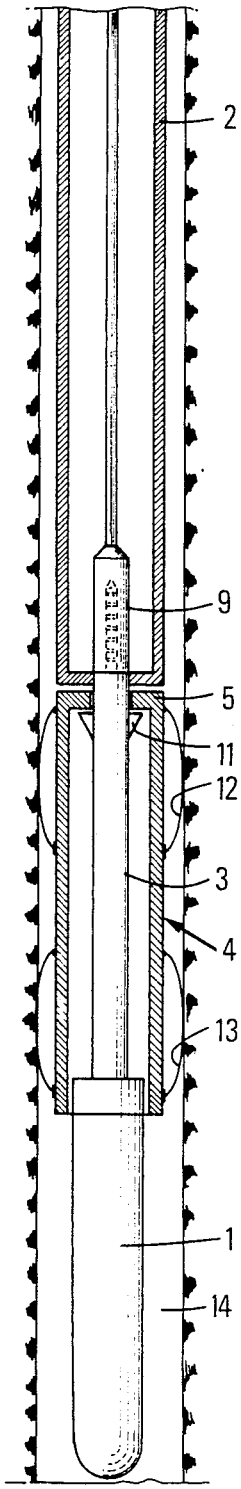

This may be achieved for example by means of second anchoring and locking means which may comprise dogs 11 (FIG. 4). Of course, still without departing from the scope of the present invention, a single anchoring or locking means may be used adapted for immobilizing the casing in the tool extended position and in the tool retracted position.

Figure 3:
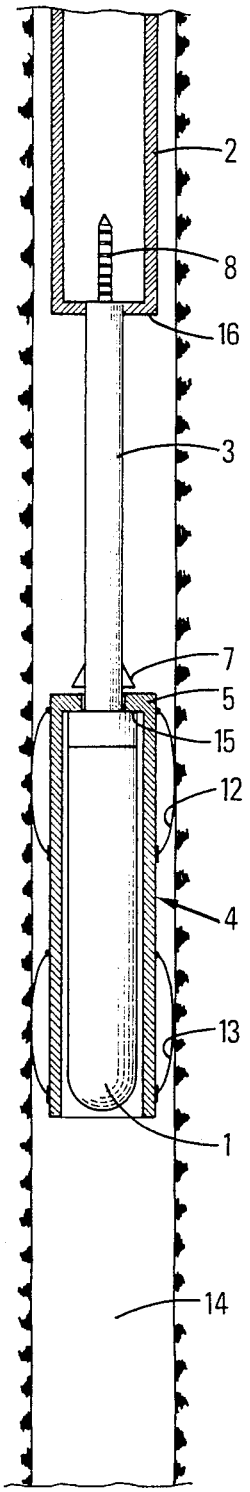
FIGS. 3 and 4 illustrate a second embodiment in which the device of the invention includes means for centering the casing in a well.

FIGS. 3 and 4 show the case where the protective casing 4 is equipped with centering tools 12 and 13. This centering tool may be of the blade type.

The use of centering tools maintains the casing in the center of the well, and consequently the tool in the case where the tool is centered with respect to the casing.

In addition, in some cases, it is the centering tools which induce a friction force between the casing and the well 14.

Moreover, the embodiment shown in FIGS. 3 and 4 illustrates a device of the invention having first means 7 for anchoring or locking the casing in the probe protected position and second means 11 for anchoring and locking the casing 4 in the probe 1 extended position (FIG. 4).

The first locking means comprise dogs 7 which cooperate with an axial bearing surface 15 integral with tool 1 for defining a space which will limit the movement of the second guide member 5 which, in this case, will also play the role of axial stop.

The same goes for the second locking means. The movement of the second guide members 5 which serve as axial stops is limited on the one hand by an axial bearing surface 16 integral with the drill string and by the dogs 11.

The dogs of the first and second locking means are included in the space defined by the bearing surface integral with the tool and by the bearing surfaces integral with the drill string.

Figure 5:
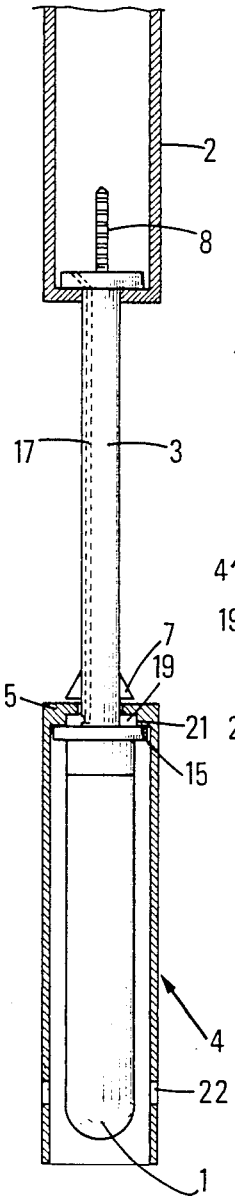
FIGS. 5 and 6 show a third embodiment in which said casing is moved by hydraulic means.
Figure 6:
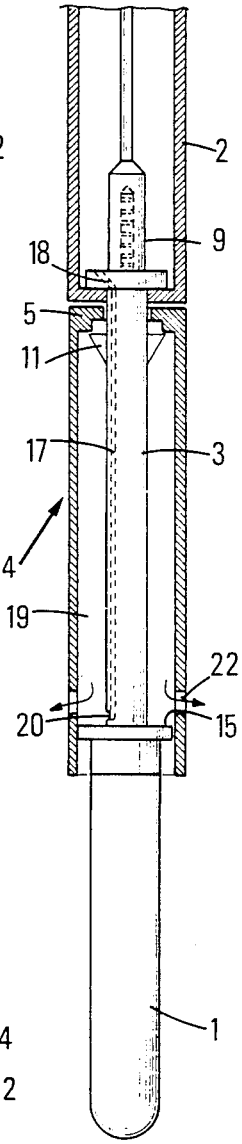

FIGS. 5 and 6 show the casing in the probe protected position and in the probe extended position respectively.

In the case of these Figures, movement of the casing is obtained by hydraulic means.

The device shown in FIGS. 5 and 6 includes a hollow drill string 2 and a passage 17 passing through the first guide member 3.

The passage 17 opens at one of its ends into the drill string 2 through an orifice 18 and at its other end into a chamber 19 defined by the second guide member 5 and the bearing surface 15 integral with the tool through an orifice 20.

In the upper part of the casing a clearance 21 has been provided so as to better allow the pressure forces to cause movement of casing 4 in the probe extended position, when the anchoring or locking means 7 are retracted.

Thus, when fluid is pumped inside the drill string, it passes through passage 17, arrives in clearance 21 and causes chamber 19 to expand casing 4 to rise. This operation is equivalent to that of a hydraulic cylinder.

Casing 4 may include orifices 22 situated in the lower part of the casing 4 so that these orifices are uncovered when the probe is extended. This will allow the pumped fluid to flow.

The device shown in FIG. 6 includes means 11 for locking or anchoring the casing in the tool extended position.

For moving the casing in the probe protected position, after stopping pumping of the fluid the means 11 for locking the casing may be retracted and a pull exerted on the drill string 2 until the casing 4 covers tool 1 again, then the first locking means 7 may be tripped.

Of course, other means may be used for moving the casing into the tool protected position, particularly hydraulic systems the reverse of those described above whose operations will be equivalent to that of a double acting cylinder.

The control of the different valves required for operating such a device equivalent to a double acting cylinder could be provided by electric signals or by information transmitted by the fluid flowing in the drill string, particularly by inserting flow rate or pressure sensors.

It is evident that if the female connector 9 is lowered by pumping a flow orifice may be provided in the low part of the column. This orifice may be closed when the female connector is in place.

In one embodiment of the device of the invention it will be possible, when it is desired to work in a given zone of the well, to lower the tool and the casing beyond the working zone, the casing then being in the tool protected position, then to extract the tool and return to the working zone.

Such a method of operation avoids penetrating into the well with the tool extended and so avoids destruction of the tool against an obstructing element in the well such as cave-ins.

What is claimed is:

1. A retractable protective device for a specialized tool for working in a well with said tool being fixed to the end of a drill string, said device comprising a casing for protecting said tool, said drill string having substantially at its end and before said tool a first guide member and said casing having a second guide member, said first and second guide members being adapted for cooperating with each other so as to allow relative movement of said casing with respect to said tool and to said drill string.

2. The device according to claim 1, further comprising means for locking said casing relatively to an assembly formed by said drill string and said tool.

3. The device according to claim 2, wherein said locking means are adapted for immobilizing said casing when the casing is in a position protecting said tool.

4. The device according to claim 2, wherein said locking means are adapted for immobilizing said casing when said casing does not protect said tool.

5. The device according to claim 1, comprising means for centering said casing in the well.

6. The device according to claim 1, comprising means for moving said casing relative to an assembly formed by said drill string and said tool.

7. A method for protecting a specialized tool for operating in a well with a casing and for using the tool within the well, said tool being fixed to the end of a drill string and said casing being mounted for sliding relative to an assembly formed by said tool and said drill string, which comprises positioning said tool in the well within the casing and effecting relative movement of the casing with respect to said tool and to said drill string to position the tool outside of said casing.

8. The method according to claim 7, which comprises moving the assembly formed by said drill string and said tool for causing the tool to leave the protective casing.

9. The method according to claim 7, for working with said tool in a given zone of the well, which comprises moving the assembly formed by said drill string and said casing into a position of protection beyond said zone and uncovering said tool during a movement or just before a movement of said assembly in the opposite direction and before again reaching said zone.

10. The device according to claim 1, wherein said specialized tool is a measuring instrument.

11. The device according to claim 1, wherein the specialized tool is a working tool.

12. The device according to claim 6, wherein said means for moving said casing relative to the assembly comprises hydraulic means including a hollow drill string and a passage extending through a first guide member, said first guide member extending from the drill string to the specialized tool and a second guide means operatively associated with an end portion of the casing and spaced from a bearing surface on said tool for defining a space for receiving a fluid for causing movement of the casing from a protecting position to a position wherein the tool is in the extended position outside of said casing.

13. The device according to claim 3, further comprising means for moving said casing relative to the assembly formed by said drill string and said tool.

14. The device according to claim 2, further comprising means for moving said casing relative to the assembly formed by said drill string and said tool.

15. A method according to claim 7, wherein said tool is fixed to the end of the drill string by a guide means, which comprises moving said casing away from said tool and towards said drill string along said guide means to position the tool outside of said casing.

16. A method according to claim 7, which comprises moving said drill string towards said casing and simultaneously moving said tool away from said casing to position tool outside of said casing.

* * * * *